US007182653B1

(12) United States Patent
Hoxha

(10) Patent No.: US 7,182,653 B1
(45) Date of Patent: Feb. 27, 2007

(54) CONNECTOR ASSEMBLIES AND METHODS FOR FORMING A CONNECTION BETWEEN CABLES

(75) Inventor: Vladimir Hoxha, Toronto (CA)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/408,646

(22) Filed: Apr. 21, 2006

(51) Int. Cl.
*H01R 11/01* (2006.01)

(52) U.S. Cl. ..... 439/783; 439/782; 439/863

(58) Field of Classification Search ..... 439/783, 439/775, 863
See application file for complete search history.

(56) References Cited

U.S. PATENT DOCUMENTS

| | | | | |
|---|---|---|---|---|
| 1,278,785 | A * | 9/1918 | Tainter | 403/391 |
| 1,953,709 | A * | 4/1934 | Gateka | 439/782 |
| 2,799,108 | A | 7/1957 | Kopf et al. | |
| 2,972,746 | A | 2/1961 | Skumawitz | |
| 3,216,140 | A | 11/1965 | Termet | |
| 3,345,454 | A | 10/1967 | Mixon | |
| 3,515,794 | A | 6/1970 | Beinhaur et al. | |
| 3,563,439 | A | 2/1971 | Pomeroy | |
| 3,681,512 | A | 8/1972 | Wemer et al. | |
| 3,742,582 | A | 7/1973 | Broske | |
| 3,761,602 | A | 9/1973 | De Sio et al. | |
| 3,826,860 | A | 7/1974 | De Sio et al. | |
| 4,252,992 | A | 2/1981 | Cherry et al. | |
| 4,705,200 | A | 11/1987 | Kopf et al. | |
| 4,722,189 | A | 2/1988 | Center | |

(Continued)

FOREIGN PATENT DOCUMENTS

| | | |
|---|---|---|
| DE | 1146459 | 3/1963 |
| FR | 1117298 | 5/1956 |
| FR | 1378478 | 11/1964 |
| WO | WO 2004/015815 A1 | 2/2004 |

OTHER PUBLICATIONS

AMP Miniwedge Connector Hand Tool 217330-1, Instruction Sheet 408-4095, Jan. 13, 1995, AMP Incorporated, Harrisburg, PA 17105, 4 pages.

(Continued)

*Primary Examiner*—Michael C. Zarroli
(74) *Attorney, Agent, or Firm*—Myers Bigel Sibley and Sajovec, P.A.

(57) ABSTRACT

A connector assembly for connecting first and second elongate electrical conductors includes an electrically conductive first connector member, an electrically conductive second connector member, and a clamping mechanism. The first connector member includes: a first body having inner and outer opposed ends; a first hook portion on the outer end of the first body, the first hook portion defining a first channel to receive the first conductor; and a first abutment portion on the inner end of the first body. The second connector member includes: a second body having inner and outer opposed ends; a second hook portion on the outer end of the second body, the second hook portion defining a second channel to receive the second conductor; and a second abutment portion on the inner end of the second body. The clamping mechanism is selectively operable to displace the first and second connector members relative to one another from an open position to a clamping position to clamp the first conductor in the first channel and between the first hook portion and the second abutment portion and to clamp the second conductor in the second channel and between the second hook portion and the first abutment portion to thereby form a connection.

21 Claims, 4 Drawing Sheets

U.S. PATENT DOCUMENTS

| | | | | |
|---|---|---|---|---|
| 4,752,252 | A | 6/1988 | Cherry et al. | |
| RE33,098 | E | 10/1989 | Center | |
| 4,905,603 | A | 3/1990 | McBain | |
| 4,945,730 | A | 8/1990 | Laney | |
| 5,239,829 | A | 8/1993 | Blake | |
| 5,244,422 | A | 9/1993 | Laricchia | |
| 5,600,096 | A | 2/1997 | Cherry et al. | |
| 5,683,273 | A | 11/1997 | Garver et al. | |
| 6,004,165 | A * | 12/1999 | Dinh et al. | 439/783 |
| 6,851,262 | B1 | 2/2005 | Gregory et al. | |
| 2004/0029455 | A1 | 2/2004 | Johnson et al. | |
| 2005/0081524 | A1 | 4/2005 | Gregory et al. | |

OTHER PUBLICATIONS

AMP Miniwedge Connectors, 83447-[ ], 83592-[ ], 83623-[ ], 83631-[ ], Instruction Sheet 408-9858, Sep. 26, 1994, AMP Incorporated, Harrisburg, PA 17105, 3 pages.

Customer Manual, *AMPACT Taps, Stirrups, and Application Tooling*, 409-2106, Rev M, Feb. 5, 1999, 39 pages.

* cited by examiner

CONNECTOR ASSEMBLIES AND METHODS FOR FORMING A CONNECTION BETWEEN CABLES

FIELD OF THE INVENTION

The present invention relates to connector assemblies and methods for forming connections and, more particularly, to connector assemblies and methods for connecting elongate electrical conductors.

BACKGROUND OF THE INVENTION

Electrical cables often must be terminated or joined in various environments, such as underground or overhead. Such cables may be, for example, high voltage electrical distribution or transmission lines. In order to form such connections, a connector may be employed. For example, in electrical power systems, it is occasionally necessary to tap into an electrical power line. One known system for tapping into an electrical power line is to use a tap connector for electrically connecting a main line electrical cable to an end of a tap line electrical cable.

One such tap connector, typically referred to as a wedge connector, includes an electrically conductive C-shaped member or sleeve and a wedge. The two cables are positioned at opposite sides of the C-shaped sleeve and the wedge is driven between the two cables. This forces the two cables against the C-shaped sleeve such that they are captured between the wedge and the C-shaped sleeve. Wedge connectors are commonly installed using an explosively driven connecting tool (sometimes referred to as a powder actuated tool). The C-shaped sleeve is held in place on a tool head connected to a tool body including a cartridge chamber. The cartridge chamber accepts a gunpowder shell casing with a powder charge that is activated by striking the casing with a hammer. The explosion drives a ram that forces the wedge portion of the connector between the two cables.

SUMMARY OF THE INVENTION

According to embodiments of the present invention, a connector assembly for connecting first and second elongate electrical conductors includes an electrically conductive first connector member, an electrically conductive second connector member, and a clamping mechanism. The first connector member includes: a first body having inner and outer opposed ends; a first hook portion on the outer end of the first body, the first hook portion defining a first channel to receive the first conductor; and a first abutment portion on the inner end of the first body. The second connector member includes: a second body having inner and outer opposed ends; a second hook portion on the outer end of the second body, the second hook portion defining a second channel to receive the second conductor; and a second abutment portion on the inner end of the second body. The clamping mechanism is selectively operable to displace the first and second connector members relative to one another from an open position to a clamping position to clamp the first conductor in the first channel and between the first hook portion and the second abutment portion and to clamp the second conductor in the second channel and between the second hook portion and the first abutment portion to thereby form a connection.

According to further embodiments of the present invention, a connection includes first and second elongate electrical conductors and a connector assembly. The connector assembly includes an electrically conductive first connector member, an electrically conductive second connector member, and a clamping mechanism. The first connector member includes: a first body having inner and outer opposed ends; a first hook portion on the outer end of the first body, the first hook portion defining a first channel, wherein the first conductor is disposed in the first channel; and a first abutment portion on the inner end of the first body. The second connector member includes: a second body having inner and outer opposed ends; a second hook portion on the outer end of the second body, the second hook portion defining a second channel, wherein the second conductor is disposed in the second channel; and a second abutment portion on the inner end of the second body. The clamping mechanism is selectively operable to displace the first and second connector members relative to one another from an open position to a clamping position to clamp the first conductor in the first channel and between the first hook portion and the second abutment portion and to clamp the second conductor in the second channel and between the second hook portion and the first abutment portion to thereby form the connection.

According to method embodiments of the present invention, a method for forming a connection between first and second elongate electrical conductors includes: providing a connector assembly including an electrically conductive first connector member, an electrically conductive second connector member, and a clamping mechanism. The first connector member includes: a first body having inner and outer opposed ends; a first hook portion on the outer end of the first body, the first hook portion defining a first channel; and a first abutment portion on the inner end of the first body. The second connector member includes: a second body having inner and outer opposed ends; a second hook portion on the outer end of the second body, the second hook portion defining a second channel; and a second abutment portion on the inner end of the second body. The method further includes: while the connector assembly is in an open position, placing the first conductor in the first channel and the second conductor in the second channel; and thereafter selectively operating a clamping mechanism of the connector assembly to displace the first and second connector members relative to one another from the open position to a clamping position to clamp the first conductor in the first channel and between the first hook portion and the second abutment portion and to clamp the second conductor in the second channel and between the second hook portion and the first abutment portion to thereby form the connection.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
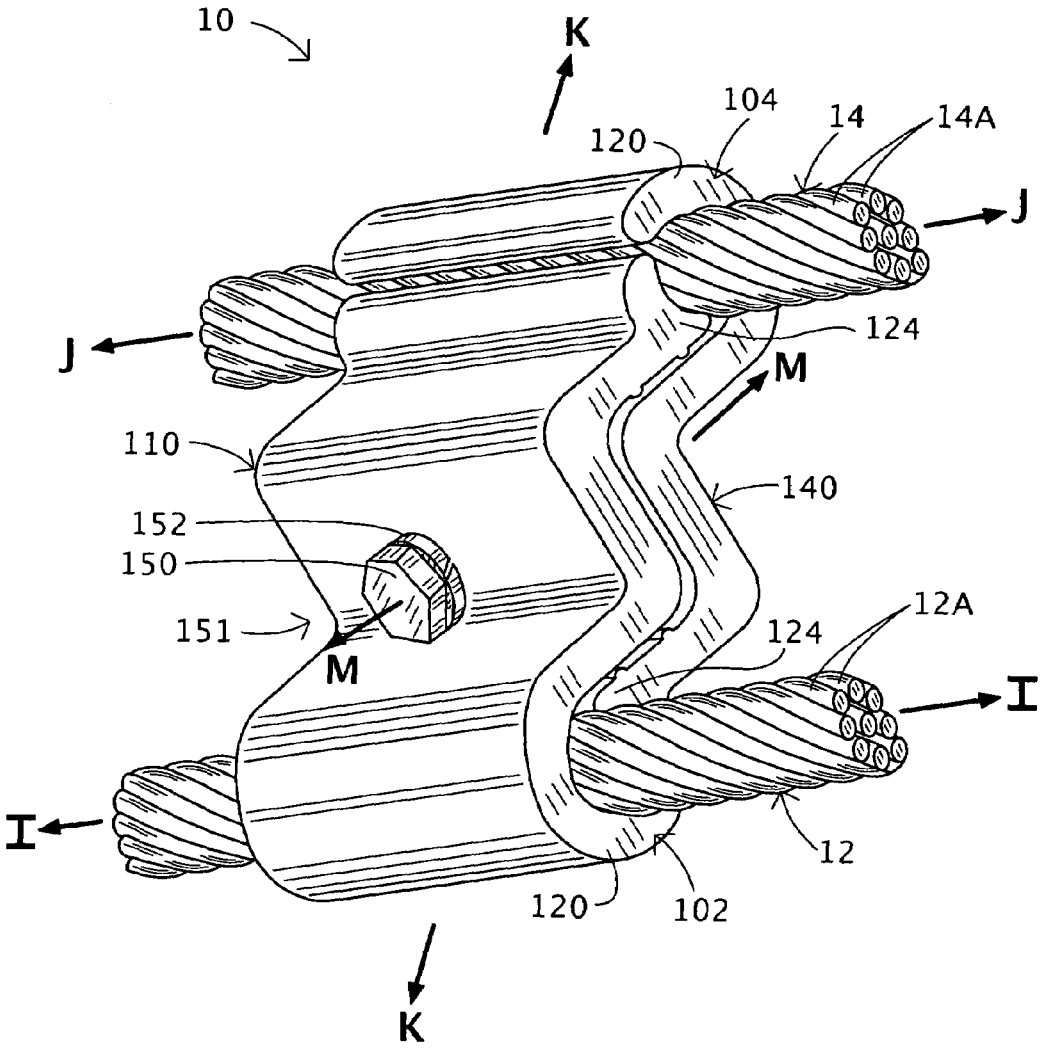
FIG. 1 is a perspective view of a connection including a connector assembly according to some embodiments of the present invention and a pair of cables.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Figure 4:
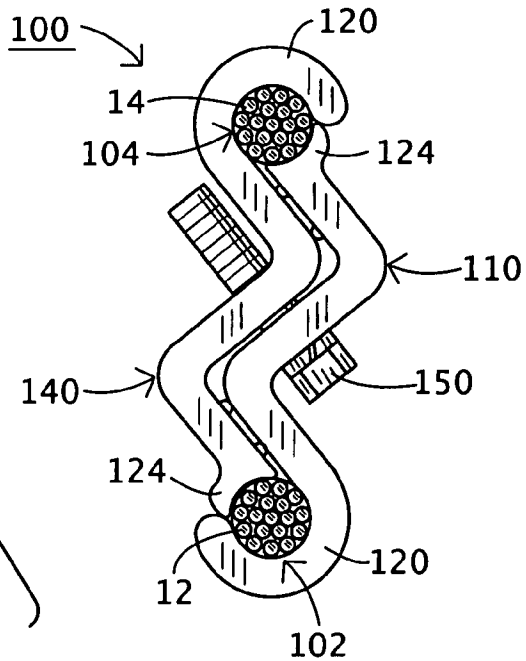
FIG. 4 is an end view of connection of FIG. 1.

With reference to FIGS. 1–4, methods and a connector assembly 100 according to embodiments of the present invention may be used to form a connection 10 (FIGS. 1 and 4). The connection 10 includes a pair of elongate cables or conductors 12, 14 mechanically and electrically coupled by the connector assembly 100. According to some embodiments, the conductors 12, 14 each include a plurality of elongate strands 12A, 14A. Generally, and as described in more detail below, a driver 154 (FIG. 3) may be used to secure the connector assembly 100 on the conductors 12, 14.

Figure 2:
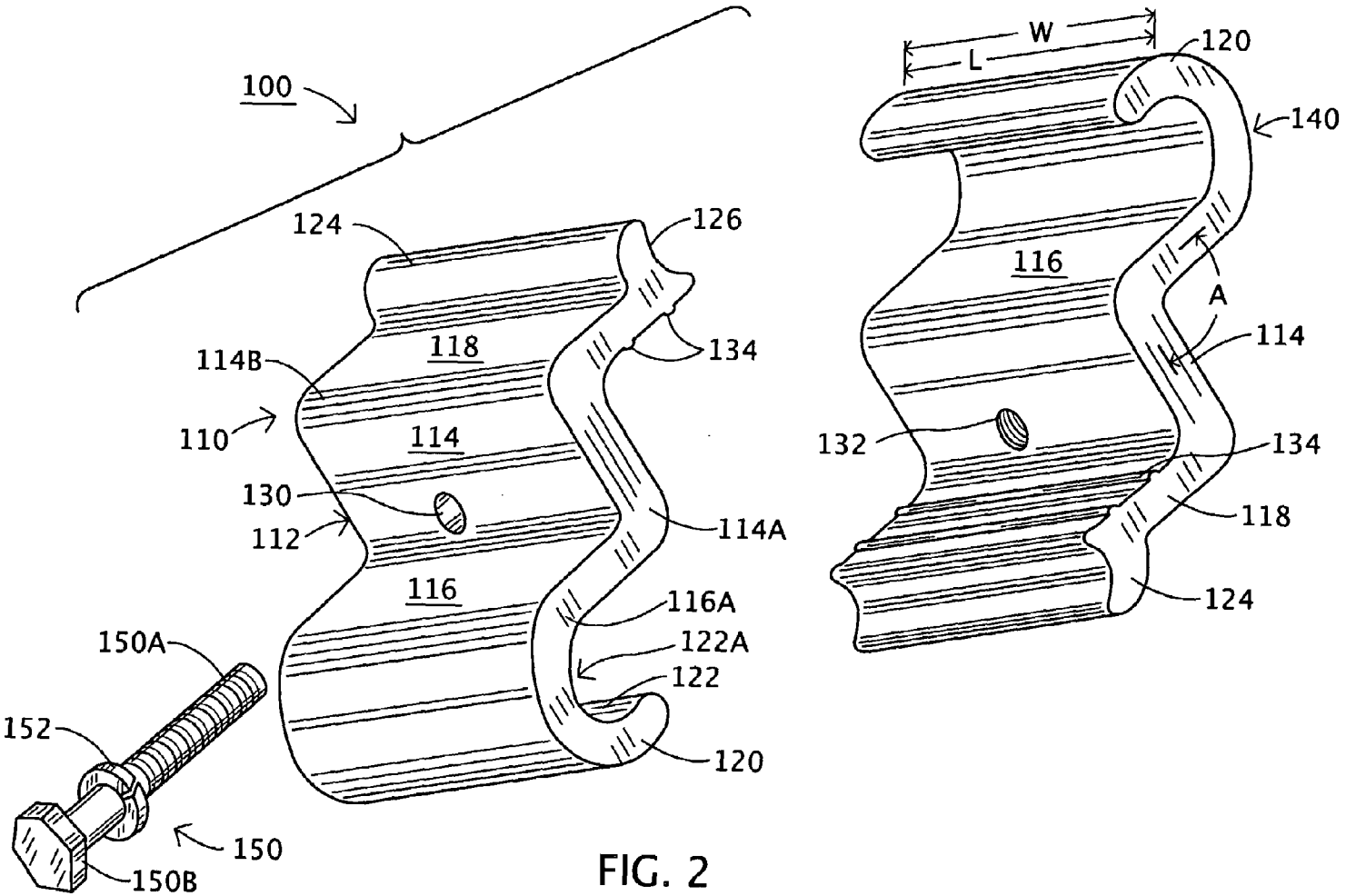
FIG. 2 is an exploded perspective view of the connector assembly of FIG. 1.

With reference to FIGS. 1 and 2, the connector assembly 100 includes a first connector member 110 and a second connector member 140, which together define opposed cable passages 102, 104 for receiving the cables 12, 14. The connector assembly 100 further includes a clamping mechanism 151 that provides a loading force and secures the connector members 110, 140 in a desired position. According to some embodiments, the connector members 110, 140 have the same configuration, shape or profile except as discussed below. Accordingly, the connector member 110 will now be described in more detail, it being appreciated that the description of the connector member 110 likewise applies to the connector member 140.

The connector member 110 includes a generally S-shaped or Z-shaped body 112. The body 112 includes an intermediate section 114, an outer leg section 116, and an inner leg section 118. The outer leg section 116 is joined to the intermediate section 114 by a bend 114A. The inner leg section 118 is joined to the intermediate section 114 by a bend 114B.

A U-shaped receiver portion or hook portion 120 extends from the distal end of the leg section 116 opposite the intermediate section 114. A bend 116A is provided between the hook portion 120 and the section 116. The hook portion 120 includes a seat surface 122 defining a transverse, arcuate, concave (semi-cylindrical) channel 122A.

An abutment portion 124 is provided on the inner leg section 118. The abutment portion 124 has a seat surface 126 defining a transverse, arcuate, concave (semi-cylindrical) channel 126A.

Spacer portions such as ribs 134 extend transversely along the inner surface of the leg section 118.

In the case of the connector member 110, a non-threaded bore 130 extends through the intermediate section 114. In the case of the connector member 140, a relatively enlarged, threaded bore 132 extends through the intermediate section 114.

The connector members 110, 140 are relatively inverted and nested as shown in FIGS. 1 and 4. That is, the connector members 110, 140 are rotated 180 degrees with respect to one another so that the abutment portion 124 of the connector member 110 is proximate the hook portion 120 of the connector member 140 and the abutment portion 124 of the connector member 140 is proximate the hook portion 120 of the connector member 110. The adjacent seat surfaces 122, 126 face one another and define the respective cable passages 102, 104 therebetween. The channels 126A of the connector members 110, 140 define the respective channel axes I—I and J—J (FIG. 1). A connector longitudinal axis K—K (FIGS. 1 and 3) is transverse to and extends through the axes I—I and J—J. According to some embodiments and as shown, the axes I—I and J—J are parallel to one another and perpendicular to the axis K—K. According to some embodiments, the axes I—I and J—J define a plane in which the axis K—K lies.

A bolt 150, the threaded bore 132 and the intermediate section 114 of the connector member 140 cooperatively serve as the clamping mechanism 151. The bores 130, 132 are aligned and the shank 150A of the bolt 150 extends through the bores 130, 132. The shank 150A is threaded and threadedly engages the bore 132 but is capable of sliding loosely in the bore 130. A head 150B of the bolt 150 is oversized relative to the bore 130. A lock washer 152 may be positioned between the head 150B and the intermediate section 114 of the connector member 110.

Figure 3:
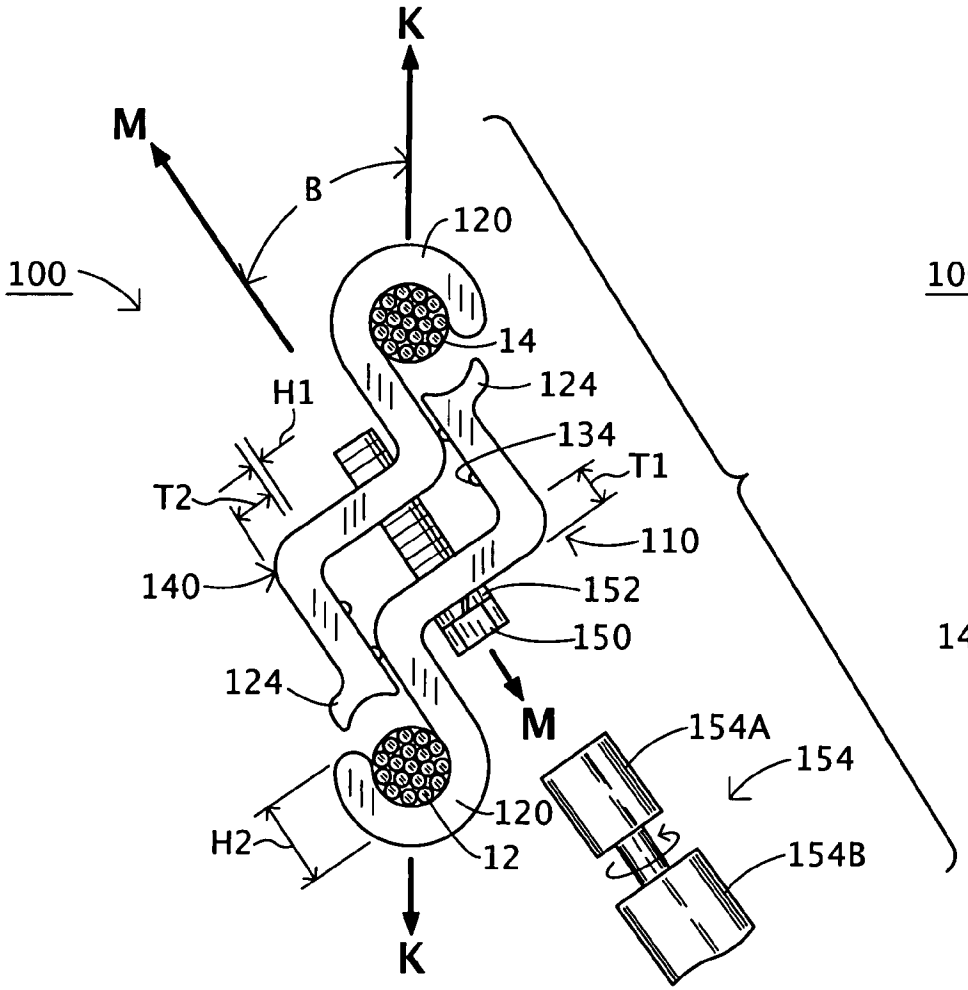
FIG. 3 is an end view of the connector assembly of FIG. 1 in an open position with the cables mounted therein and a driver.

The clamping mechanism 151 is configured to translate the connector members 110, 140 relative to one another along a translation axis M—M (FIGS. 1 and 3). According to some embodiments, the translation axis M—M is non-perpendicular to the connector longitudinal axis K—K. According to some embodiments, the axis M—M is transverse to the axis K—K. According to some embodiments and as shown, the axis M—M forms an oblique angle B (FIG. 3) with the axis K—K. According to some embodiments, the angle B is between about 35 and 45 degrees and, according to some embodiments, between about 38 and 42 degrees.

According to some embodiments and as shown, the connector members 110, 140 together have 180 degree rotational symmetry (i.e., are collectively symmetric under a 180 degree rotation or are reverse mirror images of one another). That is, with the exception of the clamping mechanism 151, the connector assembly 100 is 180 degree rotationally symmetric.

The connector members 110, 140 may be formed of any suitable material. According to some embodiments, the connector members 110, 140 are formed of metal. According to some embodiments, the connector members 110, 140 are formed of aluminum or steel. According to some embodiments, the connector members 110, 140 are formed of aluminum alloy 6061 heat treated in T6 condition. The connector members 110, 140 may be formed using any suitable technique. According to some embodiments, each of the connector members 110, 140 is unitarily formed. According to some embodiments, the connector members 110, 140 are extruded and cut. Alternatively or additionally, the connector members 110, 140 may be stamped (e.g., die-cut), cast and/or machined. Because the connector members 110, 140 are identically configured other than the bores 130, 132, only one configuration needs to be produced and then bored as appropriate.

According to some embodiments and as shown, the intermediate section 114 has a thickness T1 (FIG. 3) that is greater than the thickness T2 (FIG. 3) of the leg sections 116, 118 and the hook portions 120. The increased thickness of the intermediate section 114 may provide a relatively stiff brace for the local loading of the clamping mechanism 151. According to some embodiments, the thickness T1 is between about 0.300 and 0.375 inch. According to some embodiments, the thickness T2 is between about 0.375 and 0.425 inch. According to some embodiments, the thickness T1 is between about 13 and 25% greater than the thickness T2.

According to some embodiments, the height H1 of the ribs 134 is between about 0.060 and 0.080 inch.

According to some embodiments, the bend angle A (FIG. 2) between the intermediate section 114 and the leg sections 116, 118 is between about 90 and 95 degrees. According to some embodiments, the bend angle A is between about 90 and 92.5 degrees.

According to some embodiments, the radius of curvature of the seat surfaces 122 is at least 0.570 inch. According to some embodiments, the radius of curvature of the seat surfaces 122 is between about 0.570 and 0.575 inch. According to some embodiments, each of the seat surfaces 122 extends along an arc of at least 107 degrees. According to some embodiments, each of the seat surfaces 122 extends along an arc of between about 105 and 110 degrees.

According to some embodiments, the radius of curvature of the seat surfaces 126 is at least 0.570 inch. According to some embodiments, the radius of curvature of the seat surfaces 126 is between about 0.570 and 0.575 inch. According to some embodiments, each of the seat surfaces 126 extends along an arc of at least 70 degrees. According to some embodiments, each of the seat surfaces 126 extends along an arc of about 72 and 75 degrees.

According to some embodiments, the ratio of the width W (FIG. 2) of the connector assembly 100 to the outer diameter of the cable to be received is between about 2.85 and 8.5. According to some embodiments, each of the channels 122A, 126A has a length L (FIG. 2) of between about 1.625 and 1.630 inch. According to some embodiments, the depth H2 (FIG. 3) of the channels 122A, 126A is between about 0.5 and 0.6 inch.

With reference to FIGS. 3 and 4, the connector assembly 100 can be used as follows in accordance with methods of the present invention to form the connection 10 (FIG. 1). The bolt 150 is initially backed out of the threaded bore 132 and the connector member 110 is slid apart from the connector member 140 on the bolt 150 to an open position as shown in FIG. 3. In the open position, the cable passages 102, 104 open sidewardly to permit lateral insertion of the cables 12, 14 into the respective passages 102, 104. The bolt 150 holds the connector members 110, 140 together and the widths of the connector members 110, 140 prevent over-rotation about the bolt 150 so that the proper relative orientation between the connector members 110, 140 can be easily maintained. The installer inserts the cables 12, 14 into the passages 102, 104 as shown in FIG. 3. According to some embodiments, the cable 14 is a main cable, the connector member 140 is first hooked onto the cable 14 (i.e., the cable 14 is positioned in the passage 104 as shown in FIG. 3), and the cable 12 which may be a tap cable, is then positioned in the passage 102. The U-shaped hook portions 120 may serve to temporarily retain the cables 12, 14 in the passages 102, 104. The cables 12, 14 are aligned in parallel along the connector axis K—K.

With the cables 12, 14 in position as shown in FIG. 3, the installer rotates the bolt 150 in any suitable manner. According to some embodiments, the bolt 150 is rotated using a driver such as the driver 154. The driver 154 includes a socket 154A configured to engage and drive the head 150B and a power tool 154B to drive the socket 154A. According to some embodiments, the power tool 154B is a battery-powered tool. According to some embodiments, the power tool 154B is a rechargeable battery-powered tool.

As the bolt 150 is rotated, the bolt 150 draws the connector members 110, 140 together along the translation axis M—M. The respective portions 120, 124 are thereby driven or translated towards one another along axes parallel to the axis M—M. The cable passages 102, 104 are thereby simultaneously reduced about the cables 12, 14. As the connector members 110, 140 are pulled together, the facing surfaces of the leg sections 116, 118 may slide across one another. The ribs 134 may serve to reduce friction between the surfaces and prevent or inhibit binding. The configuration of the connector assembly 100 including the oblique angle between the axis M—M and the axis K—K may facilitate operation of the clamping mechanism 151 by positioning the bolt head 150B for convenient access with the driver 154.

The installer continues to rotate and torque the bolt 150 until the cables 12, 14 are engaged by each of the seat surfaces 122, 126 and loaded thereby as desired. The connector assembly 100 may collapse or deform the cables 12, 14 in the passages 102, 104. The seat surfaces 122, 126 may form an interference fit with the cables 12, 14. The clamping mechanism 151 maintains the connector assembly 100 in this clamping position (as shown in FIG. 4). The U-shaped hook portions 120 form end enclosures that prevent endwise pullout of the cables 12, 14 from the connector assembly 100.

The arrangement of the connector assembly 100 and its clamping mechanism 151 may serve to efficiently and reliably transfer the tensile force from the bolt 150 to the cables 12, 14. According to some embodiments, the seat surfaces 122, 126 apply a clamping or compression load of at least about 3500 lbs to the cables 12, 14 when the connector assembly 100 is in the clamping position. According to some embodiments, the seat surfaces 122, 126 apply a clamping load in the range of from about 3500 to 4800 lbs.

According to some embodiments, the bolt 150 is rotated and the cables 12, 14 are loaded such that the connector members 110, 140 are elastically and plastically deflected. According to some embodiments, the U-shaped hook portions 120 are elastically deflected within the "U" and/or about the bends 116A. According to some embodiments, the inner leg sections 118 are elastically deflected about the bends 114B. According to some embodiments, the outer leg sections 116 are elastically deflected about the bends 114A. As a result of the elastic deformation of the connector members 110, 140, potential energy is stored in the connector members 110, 140 (e.g., between bends 116A and 114A) so that the hook portions 120 are thereby spring-biased against the received cables 12, 14. In use, this spring bias may serve to compensate for physical and environmental variations over the life of the connection 10, such as variations caused by heat and cooling, wind, relaxation, etc. In this way, the elastic deflection may help to ensure a consistently strong or adequate connection.

According to some embodiments, the connector assembly 100 is removable and re-usable. More particularly, the connector assembly 100 can be removed from one or both of the cables 12, 14 by unscrewing the bolt 150 to release the cable(s) 12, 14, and thereafter re-installing the connector assembly 100 on the cable(s) 12, 14 or a different set of cables in the same manner as described above.

Figure 5:
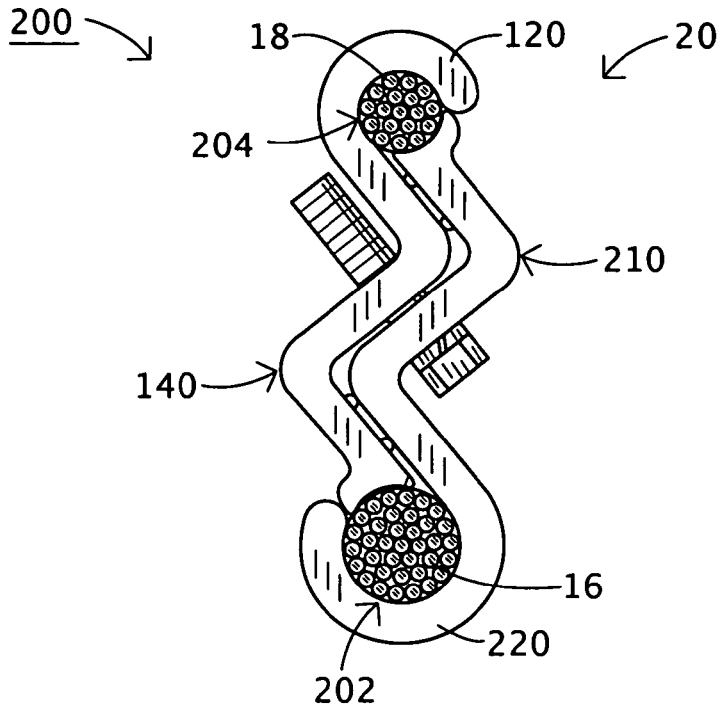
FIG. 5 is an end view of a connection including a connector assembly according to further embodiments of the present invention.

With reference to FIG. 5, a connection 20 including a connector assembly 200 according to further embodiments of the present invention is shown therein. The connector assembly 200 includes the connector member 140 and corresponds to the connector assembly 100 except as follows. A connector member 210 is provided in place of the connector member 110. The connector member 210 differs from the connector member 110 in that the connector member 210 is larger in size than the connector member 110 so that the connector assembly 200 is rotationally asymmetric. As a result, the cable passages 202, 204 have different sizes or diameters.

The different size cable passages 202, 204 may be used to better accommodate a connection between cables having different sizes. For example, a main line cable 16 may be installed in the cable passage 202 and a smaller tap line cable 18 may be installed in the cable passage 204. Various sizes of connector members 110, 140, 210 may be mixed and matched to selectively provide various sizes of cable passages in various combinations.

According to some embodiments, the connector members of a connector assembly have the same configuration except for the size of the hook portions 120, 220. In this way, the above described interoperability between the connector members of different sizes can be maintained.

Figure 6:
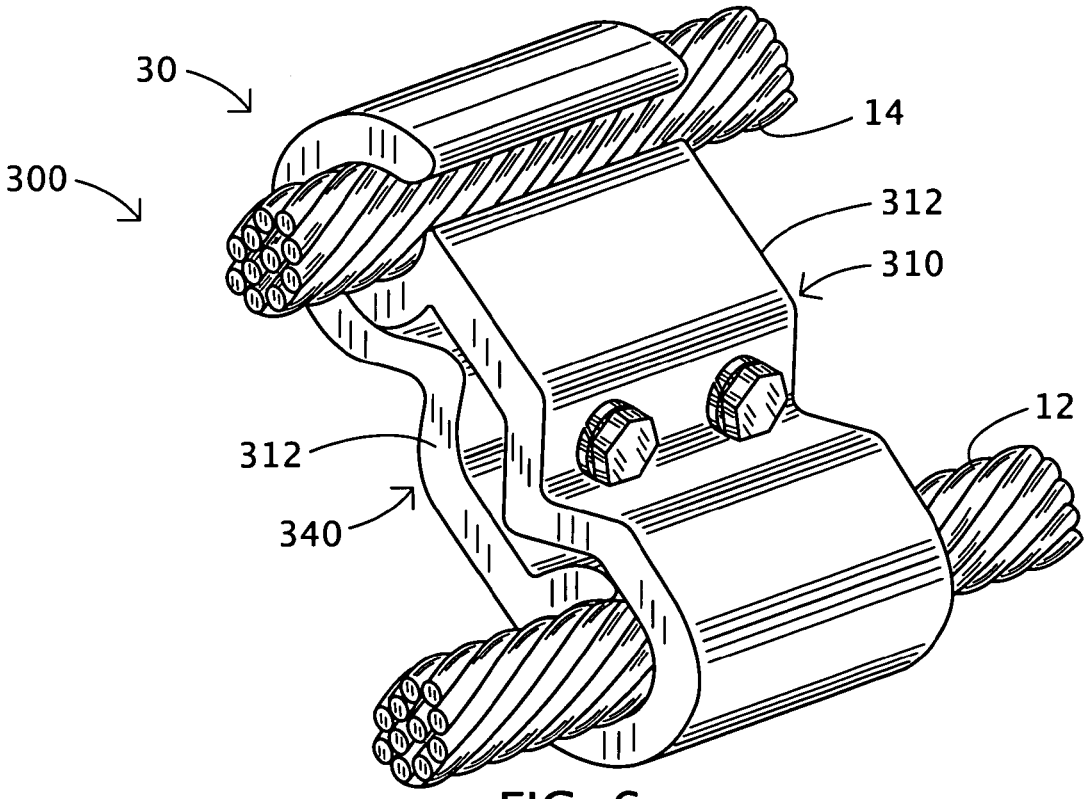
FIG. 6 is a perspective view of a connection including a connector assembly according to further embodiments of the present invention.

With reference to FIG. 6, a connection 30 including a connector assembly 300 according to further embodiments of the present invention is shown therein. The connector assembly 300 generally corresponds to the connector assembly 100 except that two clamping mechanisms 351 are provided and the bodies 312 of the connector members 310, 340 are shaped differently from the bodies 112 of the connector members 110, 140, which may alter the performance of the connector assembly 300. Other configurations of connector members may also be employed in accordance with embodiments of the present invention.

Connector assemblies according to embodiments of the invention may employ more or fewer clamping mechanisms than shown for the exemplary embodiments. According to some embodiments, other types of clamping mechanisms may be employed.

The methods and connector assemblies in accordance with embodiments of the present invention may provide the advantages of relatively slow displacement tools (including battery-powered tools). As compared to at least some explosive actuated tools, the present methods and connector assemblies may provide improvements in simplicity, safety, speed, reduction in training requirements, environmental impact, ergonomics, and cost savings. Hand and battery operated tools may also be employed in countries, environments and applications where use of explosives is limited.

According to some embodiments, the cables 12, 14 are aerial power transmission cables. According to some embodiments, the cable 14 is a main line electrical cable and cable 12 is a tap line electrical cable. According to some embodiments, one of the cables 12, 14 may be replaced with a bar, stirrup or the like.

According to some embodiments, the cables 12, 14 have a diameter of from about 0.162 to 0.563 inch.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

The invention claimed is:

1. A connector assembly for connecting first and second elongate electrical conductors, the connector assembly comprising:

a) an electrically conductive first connector member including:
   - a first body having inner and outer opposed ends;
   - a first hook portion on the outer end of the first body, the first hook portion defining a first channel to receive the first conductor; and
   - a first abutment portion on the inner end of the first body;

b) an electrically conductive second connector member including:
   - a second body having inner and outer opposed ends;
   - a second hook portion on the outer end of the second body, the second hook portion defining a second channel to receive the second conductor; and
   - a second abutment portion on the inner end of the second body; and c) a clamping mechanism selectively operable to displace the first and second connector members relative to one another from an open position to a clamping position to clamp the first conductor in the first channel and between the first hook portion and the second abutment portion and to clamp the second conductor in the second channel and between the second hook portion and the first abutment portion to thereby form a connection.

2. The connector assembly of claim 1 wherein the clamping mechanism is selectively operable to translate the first and second connector members relative to one another from the open position to the clamping position along a translation axis.

3. The connector assembly of claim 2 wherein:

a connector axis extends through the first and second channels; and the translation axis is non-perpendicular to the connector axis.

4. The connector assembly of claim 3 wherein the translation axis forms an oblique angle with the connector axis.

5. The connector assembly of claim 4 wherein the oblique angle is in the range of from about 35 to 45 degrees.

6. The connector assembly of claim 2 including at least one spacer portion extending from at least one of the first and second bodies between the first and second bodies.

7. The connector assembly of claim 1 wherein at least one of the first and second connector members is adapted to be elastically deflected when the connector assembly is in the clamping position about the first and second conductors such that the connector assembly is spring biased against at least one of the first and second conductors.

8. The connector assembly of claim 1 wherein the clamping mechanism includes a threaded member that extends through the first and second connector members.

9. The connector assembly of claim 8 wherein the first connector member includes a threaded bore extending therethrough and the threaded member threadedly engages and extends through the threaded bore.

10. The connector assembly of claim 8 wherein the threaded member includes a head portion adapted to engage a driver to rotate the threaded member.

11. The connector assembly of claim 1 wherein the first and second abutment portions each define a respective concave channel to receive a respective one of the first and second conductors.

12. The connector assembly of claim 1 wherein the first and second bodies are generally S-shaped or Z-shaped.

13. The connector assembly of claim 1 wherein:

each of the first and second bodies includes a intermediate section, an outer leg section extending from the intermediate section to the outer end, and an inner leg section extending from the intermediate section to the inner end; and the clamping mechanism is located on the intermediate sections of the first and second bodies.

14. The connector assembly of claim 13 wherein the intermediate sections have a greater thickness than the inner and outer leg sections.

15. The connector assembly of claim 1 wherein the first and second connector members have substantially the same profile.

16. The connector assembly of claim 15 wherein the first and second connector members have substantially the same size.

17. The connector assembly of claim 15 wherein the first and second connector members have different sizes from one another to accommodate first and second conductors having different sizes from one another.

18. The connector assembly of claim 1 wherein the connector assembly is adapted to provide a clamping load of at least about 3500 lbs to the first and second conductors when the connector assembly is in the clamping position.

19. A connection comprising:

a) first and second elongate electrical conductors; and b) a connector assembly including:

an electrically conductive first connector member including:

a first body having inner and outer opposed ends;

a first hook portion on the outer end of the first body, the first hook portion defining a first channel, wherein the first conductor is disposed in the first channel; and a first abutment portion on the inner end of the first body;

an electrically conductive second connector member including:

a second body having inner and outer opposed ends;

a second hook portion on the outer end of the second body, the second hook portion defining a second channel, wherein the second conductor is disposed in the second channel; and a second abutment portion on the inner end of the second body; and a clamping mechanism selectively operable to displace the first and second connector members relative to one another from an open position to a clamping position to clamp the first conductor in the first channel and between the first hook portion and the second abutment portion and to clamp the second conductor in the second channel and between the second hook portion and the first abutment portion to thereby form the connection.

20. The connection of claim 19 wherein the first and second conductors are each aerial power transmission cables.

21. A method for forming a connection between first and second elongate electrical conductors, the method comprising:

a) providing a connector assembly comprising:

an electrically conductive first connector member including:

a first body having inner and outer opposed ends;

a first hook portion on the outer end of the first body, the first hook portion defining a first channel; and a first abutment portion on the inner end of the first body;

an electrically conductive second connector member including:

a second body having inner and outer opposed ends;

a second hook portion on the outer end of the second body, the second hook portion defining a second channel; and a second abutment portion on the inner end of the second body;

b) while the connector assembly is in an open position, placing the first conductor in the first channel and the second conductor in the second channel; and thereafter c) selectively operating a clamping mechanism of the connector assembly to displace the first and second connector members relative to one another from the open position to a clamping position to clamp the first conductor in the first channel and between the first hook portion and the second abutment portion and to clamp the second conductor in the second channel and between the second hook portion and the first abutment portion to thereby form the connection.

* * * * *